United States Patent [19]

DeMaria et al.

[11] 4,303,607

[45] Dec. 1, 1981

[54] PROCESS FOR MELT SPINNING ACRYLONITRILE POLYMER FIBER USING HOT WATER AS STRETCHING AID

[75] Inventors: Francesco DeMaria; Chi C. Young, both of Gulf Breeze, Fla.

[73] Assignee: American Cyanamid Company, Stamford, Conn.

[21] Appl. No.: 201,099

[22] Filed: Oct. 27, 1980

[51] Int. Cl.[3] ..... D01D 5/08

[52] U.S. Cl. ..... 264/178 F; 264/203; 264/206; 264/210.3; 264/210.7

[58] Field of Search ..... 264/206, 178 F, 176 F, 264/210.3, 210.7, 205, 206, 203

[56] References Cited

U.S. PATENT DOCUMENTS

| | | | |
|---|---|---|---|
| 2,323,383 | 7/1943 | Dreyfus | 264/176 F |
| 2,425,782 | 8/1947 | Bludworth et al. | 264/203 |
| 3,410,940 | 11/1968 | Henderson et al. | 264/203 |
| 3,415,922 | 12/1968 | Carter et al. | 264/203 |
| 4,163,770 | 8/1979 | Povosoff | 264/206 |

*Primary Examiner*—Jay H. Woo

*Attorney, Agent, or Firm*—Frank M. Van Riet

[57] ABSTRACT

Orientation stretching of acrylonitrile polymer fiber spun from a polymer-water melt directly into a steam-pressurized solidification zone is more readily accomplished when hot, liquid water is used to wet the fiber being processed at or before the stretch rolls.

4 Claims, 1 Drawing Figure

Figure 1:
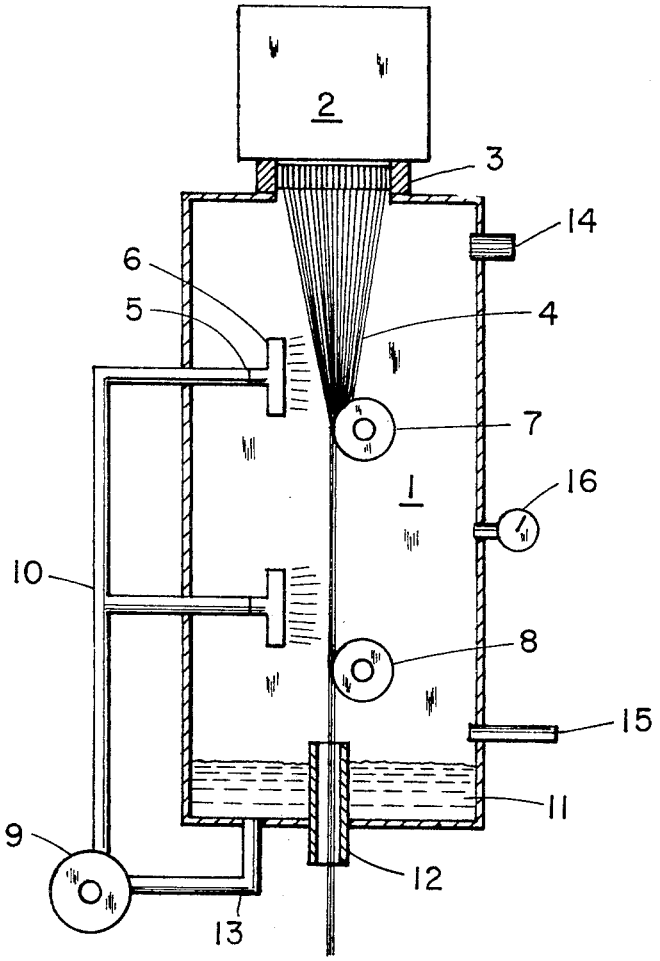

PROCESS FOR MELT SPINNING ACRYLONITRILE POLYMER FIBER USING HOT WATER AS STRETCHING AID

This invention relates to a process for melt-spinning acrylonitrile polymer fiber. More particularly, this invention relates to such a process wherein a single phase polymer-water melt is spun through a spinneret directly into a steam-pressurized solidification zone to form a tow bundle which is stretched while therein employing hot water to wet the tow bundle as it is subjected to stretching to facilitate processing.

Recent developments in the field of acrylonitrile polymer-fiber have led to provision for melt-spinning such fiber by extruding a polymer-water melt through a spinneret directly into a steam-pressurized solidification zone maintained under conditions of saturation, temperature and pressure which control the rate of release of water from the nascent filaments and enable the filaments to solidify and be drawn for molecular orientation while they remain within the solidification zone. This basic process is described in U.S. Pat. No. 4,163,770 issued Aug. 7, 1979 to H. Porosoff. This process provides melt-spun acrylonitrile polymer fiber of desirable properties and can be conducted on a commercial scale. Although the process can be effectively conducted on a single filament or a large tow bundle of filaments, stretching of tow bundles becomes increasingly difficult as the number of filaments in the bundle increases. As a result, it is generally necessary to limit the total stretch ratio employed in drawing out the filaments in order to maintain high productivity. Although reduction in the total stretch ratio still provides fiber of admirable physical properties, the use of higher stretch ratios has the effect of producing even better physical properties and, accordingly, is highly desirable.

What is desired, therefore, is a process for melt-spinning acrylonitrile polymer fiber from a polymer-water melt wherein the orientation stretching conducted in the steam-pressurized solidification zone is facilitated and enables high stretch ratios to be achieved especially with large tow bundles.

In accordance with the present invention, there is provided a process for producing an acrylonitrile polymer fiber which comprises preparing a single phase melt of acrylonitrile polymer and water, extruding said melt through a spinneret directly into a steam-pressurized solidification zone maintained under conditions of temperature, pressure and saturation that enable the nascent extrudate to solidify, and to retain sufficient water to remain in a stretchable, plastic state, said solidification zone also containing means for furnishing hot water which wets the nascent extrudate being processed, and stretching the hot water wetted extrudate in at least two stretch stages so as to provide molecular orientation thereof while it remains within said solidification zone.

The process of the present invention permits the tow bundle of filaments to be readily stretched at high stretch ratios and greatly facilitates processing. It is surprising that hot water used to wet the extrudate being processed should be responsible for facilitating processing and beneficial physical properties especially since hot water wetting of the extrudate has no beneficial effects when a single stretch stage is employed.

In carrying out processing in accordance with the present invention, the basic process of U.S. Pat. No. 4,163,770 is followed except that the nature of the solidification zone is modified to achieve the benefits of the present invention. In the process of the reference, the extrudate is shown to pass downwardly through the solidification zone. To accomplish the benefits of the present invention with such processing, it is necessary to provide means which furnish hot water to the extrudate being processed so as to wet the extrudate during processing and facilitate stretching.

Particularly desirable modifications of solidification zones are shown in a schematic view in the accompanying drawing although many other modifications encompassing the principles of the present invention are, of course, readily possible. In FIG. 1 is shown a preferred embodiment of the process of the present invention in which the means furnish hot water as sprays upon the extrudate being processed.

The principles of the present invention are that the solidification zone, into which the polymer-water melt is spun directly from the spinneret and within which the nascent extrudate is solidified and stretched, is provided with means to furnish hot water with which to wet the nascent extrudate as it is being subjected to stretching within the solidification zone. In a preferred embodiment, hot water which collects at the bottom of the solidification zone is sprayed upon the nascent extrudate at points in processing which are just before or at the stretch rolls employed in imparting the orientation stretch.

In any embodiment of the present invention, it is necessary that stretching be conducted in at least two stretch stages in order to achieve the beneficial effects of the invention. Preferably a series of stretch rolls are employed so that stretching may be accomplished in multiple stages and preferably hot water wets the extrudate as it winds about or is about to wind about the various stretch rolls.

Referring to FIG. 1 of the drawings in greater detail, a modified solidification zone is exemplified by 1 and is shown as a vertically disposed tube. Polymer-water melt from the extrudate outlet 2 is extruded through a spinneret 3 directly into the steam-pressurized solidification zone. The nascent extrudate in the form of filaments 4 are collected on first stretch roll 7. Just before the filaments are wrapped about the first stretch roll they are wetted with hot water sprayed through nozzle 5. As the filaments pass to second stretch roll 8 they are again wetted with hot water sprayed through nozzle 6. The filaments then pass out of the solidification zone through pressure seal 12. Hot water 11 which collects at the bottom of the solidification zone is drawn through exit 13 by means of a pump 9 and conduit 10 and furnished to the spray nozzles. Steam is supplied to the solidification zone through inlet 15 and exits through outlet 14. Operating temperature is indicated by thermometer 16.

In carrying out the process of the present invention, a homogeneous single phase fusion melt of an acrylonitrile polymer composition and water is employed as the spinning composition. In preparing such composition, any acrylonitrile polymer that forms a fusion melt with water may be employed. Such polymers are described in the prior art in conjunction with fusion melts thereof. A particularly desirable acrylonitrile polymer composition is one in which hydrophilic moieties are associated with the polymer since such polymers enable transparent fibers of high dye intensity and low shade change due o hot-wet processing to be obtained.

The relative proportions of water and polymer that provide a single phase fusion melt are also described in the prior art and can readily be determined from a phase diagram. It is generally desirable to prepare the melt at a temperature somewhat above the minimum melting point of the polymer-water composition in order to ensure homogeneity of the resulting melt. The melt is conveniently prepared in an extruder which is coupled to a spinneret so that the melt can be extruded through the spinneret plate employing pressure generated within the extruder. A suitable procedure for melt extrusion of a polymer-water melt is described in U.S. Pat. No. 3,991,153, issued Nov. 9, 1976 to G. K. Klausner et al. Other types of melt-spinning devices such as a piston extruder in conjunction with a spinneret, for example, may also be used.

The polymer-water melt will generally be prepared at a pressure at least equal to autogenous pressure at a temperature above the boiling point of water at atmospheric pressure and safely below the deterioration temperature of the polymer. By maintaining the polymer-water composition under sufficient pressure, water is maintained in liquid state and the fusion melt results. When the preferred hydrophilic acrylonitrile polymers are employed, it is desirable to restrict the quantities of water used to prepare the melt to the lower half of the water contents that provide single phase fusion melts at the temperature of operation selected.

Once the homogeneous single phase fusion melt has been obtained, it is extruded through a spinneret directly into a steam pressurized solidification zone. The process of the present invention is operative regardless of the number of fiber-forming orifices present in the spinneret plate. However, because the process of the present invention is particularly beneficial for processing large tow bundles, it is preferred to employ spinneret plates having a large plurality of fiber-forming orifices, usually at least about 300 orifices, since at these high orifice contents the process of the present invention greatly facilitates processing while providing high productivity per spinneret assembly.

The steam-pressurized solidification zone into which the polymer-water melt is extruded is maintained under conditions of steam saturation, temperature and pressure such that as the nascent extrudate is solidified it retains sufficient water to provide the stretchable, plastic state. While within the solidification zone, the nascent extrudate is subjected to stretching to provide molecular orientation and desirable physical properties in the resulting fiber. In order to facilitate such stretching and provide high productivity, the solidification zone is provided with means to provide hot water at a temperature in the range between about 5° C. above and about 20° C. below the temperature in the steam pressurized zone. These means are situated in such a manner that as the extrudate passes through the solidification zone, hot water will be transported so as to wet the extrudate continuously as the extrudate is continuously processed. It is desirable that the hot water wets the extrudate as it approaches or wraps about the stretch rolls which provide the molecular orientation of the polymer contained in the extrudate. It is necessary to conduct stretching in at least two stages and preferably hot water makes contact with the extrudate as it approaches or enters each stretch stage.

In conducting the orientation stretching involving a large tow bundle of filaments, such as about 300 or more, it is also necessary to conduct the stretching in at least two stages and it is desirable to wet the extrudate with hot water in conjunction with each stretch stage. With large tow bundles it has been found that wetting of the extrudate with hot water does not have a material effect on the maximum value of stretch ratio that can be productively employed in the first stage of stretching but such wetting does have a significant effect in increasing the maximum value of stretch ratio that can productively be employed in the second stage of stretching. As a result, very high total stretch ratios can be achieved and productivity is greatly enhanced without undue filament breakage.

Typically, the solidification zone will be pressurized with saturated steam at a pressure sufficient to provide a temperature therein which is from about 10° C. to about 40° C. below the minimum melting temperature of the polymer-water composition. The actual operating conditions will be influenced by many factors including the polymer composition and the like and cannot be stated in specific terms but only in the functional language employed. However, useful conditions can readily be found using the typical values indicated.

After the extrudate has been stretched while within the solidification zone as indicated, it is removed to the atmosphere and may proceed to such other processing steps as may be desired. The extrudate is exited from the solidification zone by means of a suitable pressure seal, such devices being known in the art.

One preferred processing step is to dry the resulting fiber under conditions of temperature and humidity which arise at dry bulb temperatures in the range of about 110° C. to 180° C. and wet bulb temperatures in the range of about 60° C. to 100° C. Under these conditions fiber prepared from a hydrophilic polymer composition will be essentially void-free and transparent and, as a result, it will have high dye intensity and low shade change due to hot-wet processing.

Another preferred processing step is to relax the stretched fiber in steam under pressure to obtain shrinkage in the range of about 5% to 40%. Such relaxation results in achieving a more favorable balance of physical properties. When such relaxation is conducted on fiber produced from a hydrophilic polymer composition, it is desirable to perform such relaxation after the fiber has been dried under conditions which produce an essentially transparent fiber.

The invention is more fully illustrated in the examples which follow wherein all parts and percentages are by weight unless otherwise stated.

Comparative Example A

To 83.2 parts of an acrylonitrile polymer composed of 84.7 weight percent acrylonitrile, 11.9 weight percent methyl methacrylate and 0.1 weight percent acrylamidomethylpropane sulfonic acid grafted onto 3.3 weight percent polyvinylalcohol and having a kinematic viscosity of 40,000 are added 16.8 parts of water. The polymer-water mixture is processed in a single-screw extruder into a homogeneous single phase fusion melt. The melt obtained from the single-screw extruder is spun at 158° C. at 15 grams per minute through a spinneret having 169 orifices, each of 120 microns diameter. The nascent extrudate is passed through the solidification zone, maintained at 13 pounds per square inch gauge pressure (119° C.) with saturated steam, in a horizontal direction and is subjected to a single stage of stretching. Hot water spraying means are provided above the stretch roll and hot water issuing therefrom wets the nascent extrudate as it contacts the stretch roll.

Using the spraying means and the hot water issuing therefrom to wet the nascent extrudate, the maximum stretch ratio achieved in the one stage of stretching is 30.2. Removing the spraying means so that no hot water wets the extrudate as it contacts the stretch roll, the maximum stretch ratio achieved is 31.2. This example shows that hot water wetting of the nascent extrudate does not assist in achieving higher stretch ratios in a single stage of stretching.

Example 1

The procedure of Comparative Example A is followed with the following exceptions:

1. Orifice diameter = 85 microns
2. Melt temperature = 167° C.
3. Two stretch stages employed with hot water spraying means for both stretch stages.

Spinning is conducted employing a stretch ratio of 2.4 in the first stretching stage. Employing the spraying means and wetting the processed fiber with the hot water therefrom as it contacts the stretch rolls, the maximum stretch ratio achieved in the second stage of stretching is 21.2. Removing the spraying areas so that the processed fiber is not wetted with hot water, the maximum stretch ratio achieved in the second stage of stretching is 10.7. Thus, the use of hot water to wet the processed fiber results in a maximum total stretch ratio of 50.88 compared to a maximum total stretch ratio of 25.68 when no hot water wetting is used. Fiber properties are as follows:

| | No Hot Water | With Hot Water |
|---|---|---|
| Denier | 2.0 | 1.02 |
| Straight tenacity (grams/denier) | 2.0 | 6.4 |

-continued

| | No Hot Water | With Hot Water |
|---|---|---|
| Straight elongation (%) | 37 | 27 |
| Loop tenacity (grams/denier) | 0.8 | 4.5 |
| Loop elongation (%) | 14 | 21 |
| Hot Wet Initial Modulus (grams/denier) | 0.69 | 1.6 |

Example 2

The procedure of Comparative Example 1 is followed, i.e., the solidification zone is modified in accordance with the principles illustrated in FIG. 1 and a much larger tow bundle is passed thereto from the spinneret. Using such modified solidification zone, the stretch ratio achieved in the first stretch stage is 2.0 and in the second stretch stage is 21, corresponding to a total stretch ratio of 42. No filament fusing or breakage is observed.

What is claimed:

1. A process for producing an acrylonitrile polymer fiber which comprises preparing a single phase melt of acrylonitrile polymer and water, extruding said melt through a spinneret directly into a steam-pressurized solidification zone maintained under conditions of temperature, pressure and saturation that enable the nascent extrudate to solidify, and to retain sufficient water to remain in a stretchable plastic state, wetting the extrudate with hot water and stretching the wetted extrudate in at least two stretch stages so as to provide molecular orientation thereof while it remains within said solidification zone.

2. The process of claim 1 wherein hot water is collected from the bottom of said solidification zone and sprayed onto the nascent extrudate as said extrudate is stretched.

3. The process of claim 1 wherein said acrylonitrile polymer composition is hydrophilic.

4. The process of claim 2 wherein said acrylonitrile polymer composition is hydrophilic.

* * * * *